US007914390B2

(12) United States Patent
Seiter et al.

(10) Patent No.: US 7,914,390 B2
(45) Date of Patent: Mar. 29, 2011

(54) PORTABLE SPORTS SWING TRAINING DEVICE AND METHOD

(76) Inventors: Vincent Seiter, Plymouth, MN (US); Nick Marino, Brooklyn Park, MN (US)

( * ) Notice: Subject to any disclaimer, the term of this patent is extended or adjusted under 35 U.S.C. 154(b) by 31 days.

(21) Appl. No.: 12/391,452

(22) Filed: Feb. 24, 2009

(65) Prior Publication Data

US 2009/0215555 A1 Aug. 27, 2009

Related U.S. Application Data

(60) Provisional application No. 61/031,439, filed on Feb. 26, 2008.

(51) Int. Cl.
*A63B 69/36* (2006.01)

(52) U.S. Cl. ..... 473/257; 473/229; 473/457

(58) Field of Classification Search ..... 473/219, 473/226, 229, 257, 457; 482/93, 103, 109, 482/121, 122, 127, 129, 131, 139, 904
See application file for complete search history.

(56) References Cited

U.S. PATENT DOCUMENTS

| | | | | |
|---|---|---|---|---|
| 3,462,156 | A * | 8/1969 | Gentry | 473/229 |
| 3,618,942 | A * | 11/1971 | Bates et al. | 482/129 |
| 4,328,964 | A | 5/1982 | Walls | |
| 4,611,805 | A | 9/1986 | Franklin et al. | |
| 4,625,657 | A | 12/1986 | Little et al. | |
| 5,921,904 | A | 7/1999 | Toups | |
| 5,957,819 | A * | 9/1999 | Cortesi | 482/121 |
| 6,537,184 | B2 * | 3/2003 | Kim | 482/122 |
| 6,558,302 | B2 * | 5/2003 | Cluff | 482/129 |
| 6,692,415 | B1 | 2/2004 | Winston | |
| 6,988,978 | B1 | 1/2006 | Nault et al. | |

* cited by examiner

*Primary Examiner* — Nini Legesse
(74) *Attorney, Agent, or Firm* — Altera Law Group, LLC

(57) ABSTRACT

The present invention provides a muscle training, development, stretching and warming device for sports swings. The device comprises a handle connected with an adjustable mounting device via a tensioning element of variable resistance. The tension element of a higher resistance may be substituted for a lower resistance tension element to increase the force required to swing. Further, the handle allows for adjusting the length of the resistance arm to further manipulate the force required to be provided by the user. The mounting device may be moved vertically to adjust the angle of the resistance relative to the swing plane of the user.

5 Claims, 7 Drawing Sheets

PORTABLE SPORTS SWING TRAINING DEVICE AND METHOD

CROSS-REFERENCE TO RELATED APPLICATIONS

The present application claims priority under 35 U.S.C §119(e) to provisional application No. 61/031439, filed on Feb. 26, 2008 entitled Portable Swing Exerciser.

BACKGROUND OF THE INVENTION

1. Field of the Invention

The present invention is generally directed to a muscle training and development device. More particularly, the device may be used to train and develop muscles involved in various sports swings using a racket, club, bat and the like.

2. Description of the Related Art

There are a number of devices available that seek to develop and/or train the muscles used in almost any sport or physical activity, including the muscles employed in golf, tennis and baseball swings. Almost all of the existing swing training devices are designed to work within the context of a sweeping arm motion that attempts to imitate an actual swing. The structure and function of the actual devices, however, vary widely. Many do not address the issue of developing the muscles utilized during the swing and further ignore the need to assist with stretching and flexibility. All of these are problematic for various reasons and none has become widely used.

For example, most of the patents describing sport-related swing developing devices focus on golf and apply a swing resistance that remains in a fixed location during the swing. This fails to orient the resistance in an effective direction throughout the swing, as can be seen from U.S. Pat. Nos. 4,229,002; 4,135,714; 4,253,663; 3,462,156 and 3,966,203.

A few other patents, including U.S. Pat. Nos. 5,050,874 and 5,284,464 suggest a swing resistance mounted on a central pivot so that the resistance follows a circular arc as the swing proceeds. This also is less than optimum, because a golf swing differs significantly from a circular arc.

Another U.S. Pat. No. 5,242,344 suggests a more complex movement of a swing resistance, but this requires a cumbersome and complex machine.

BRIEF SUMMARY OF THE INVENTION

The present invention provides a muscle training, development, stretching and warming device for sports swings. The device comprises a handle connected with an adjustable mounting device via a tensioning element of variable resistance. The tension element of a higher resistance may be substituted for a lower resistance tension element to increase the force required to swing. Further, the handle allows for adjusting the length of the resistance arm to further manipulate the force required to be provided by the user. The mounting device may be moved vertically to adjust the angle of the resistance relative to the swing plane of the user.

An object of the invention is to provide a portable sports swing training device.

Another object of the invention is to provide a portable sports swing training device with adjustable resistance and resistance angle.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 1:
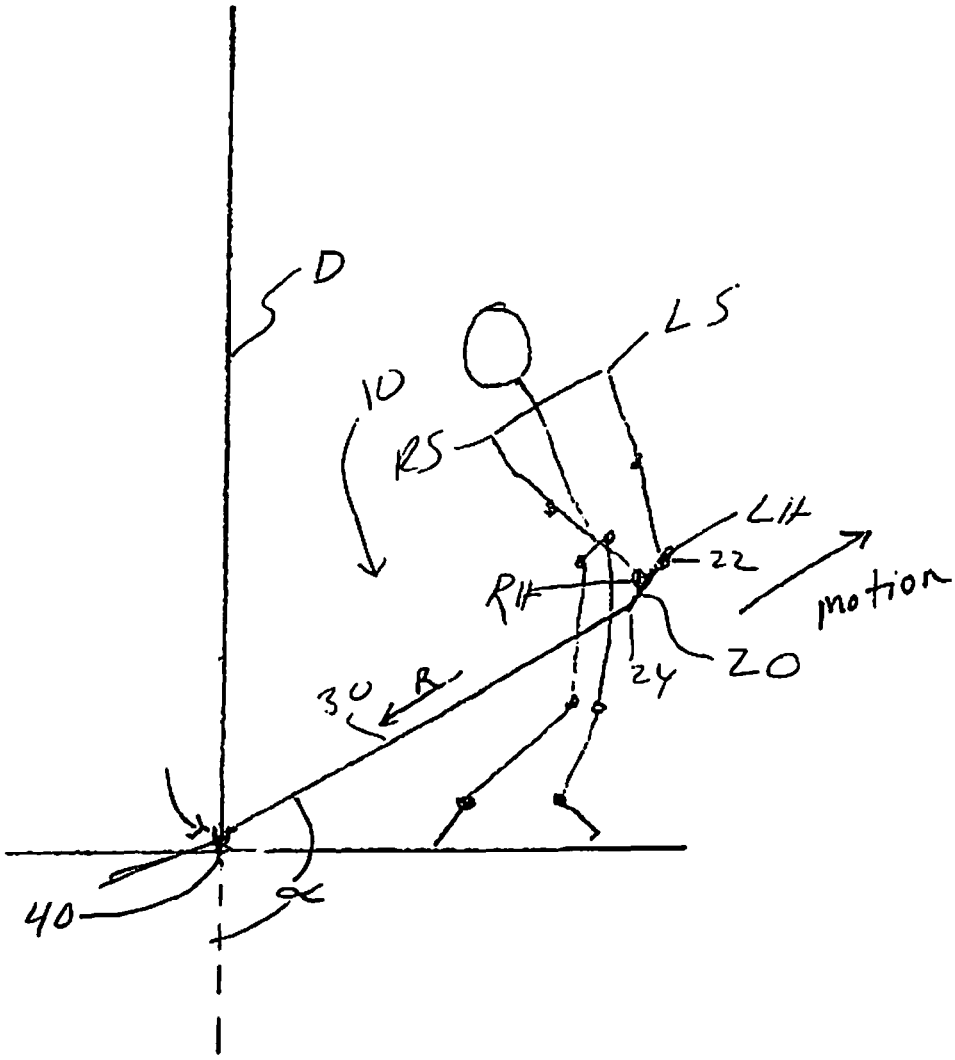
FIG. 1 illustrates one embodiment of the present invention.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

Figure 2:
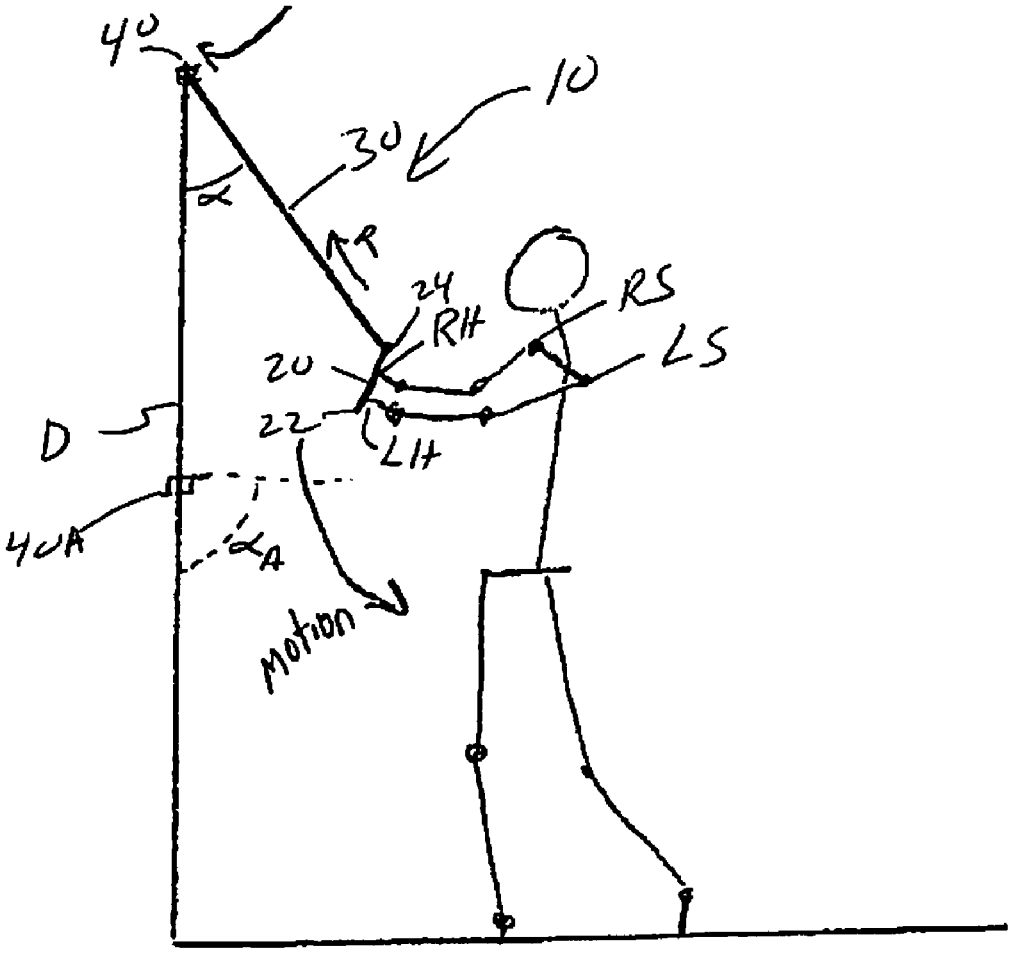
FIG. 2 is illustrates one embodiment of the present invention.

With specific reference to FIGS. 1 and 2, one embodiment of the present invention is illustrated. The sports swing training device 10 comprises a handle 20 connected to at least one tension element 30 that is adjustably fixed to the handle 20 and removably fixed to a door clip 40 that is adjustably fixed to a door D.

Figure 3:
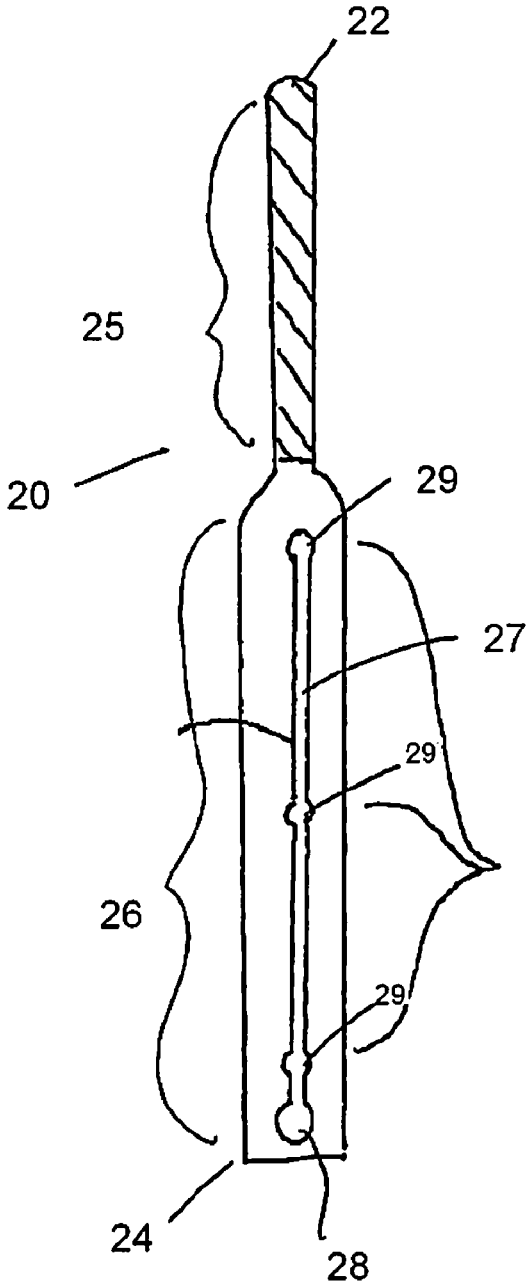
FIG. 3 is a front view of one embodiment of a handle of the present invention.

As illustrated by FIG. 3, one embodiment of the handle 20 comprises an proximal end 22 and a distal end 24, a grip portion 25 and a resistance portion 26. The user grips the grip portion 25 as illustrated in FIGS. 1 and 2. The resistance portion 26 comprises an access aperture 28, slot 27 and at least one retention aperture 29 therethrough. Access aperture 28, slot 27 and the at least one retention aperture 29 are in sliding communication with each other to facilitate installation and retention of the tension element(s) 30, and adjustment of the tension element(s) 30 therein.

Figure 4:
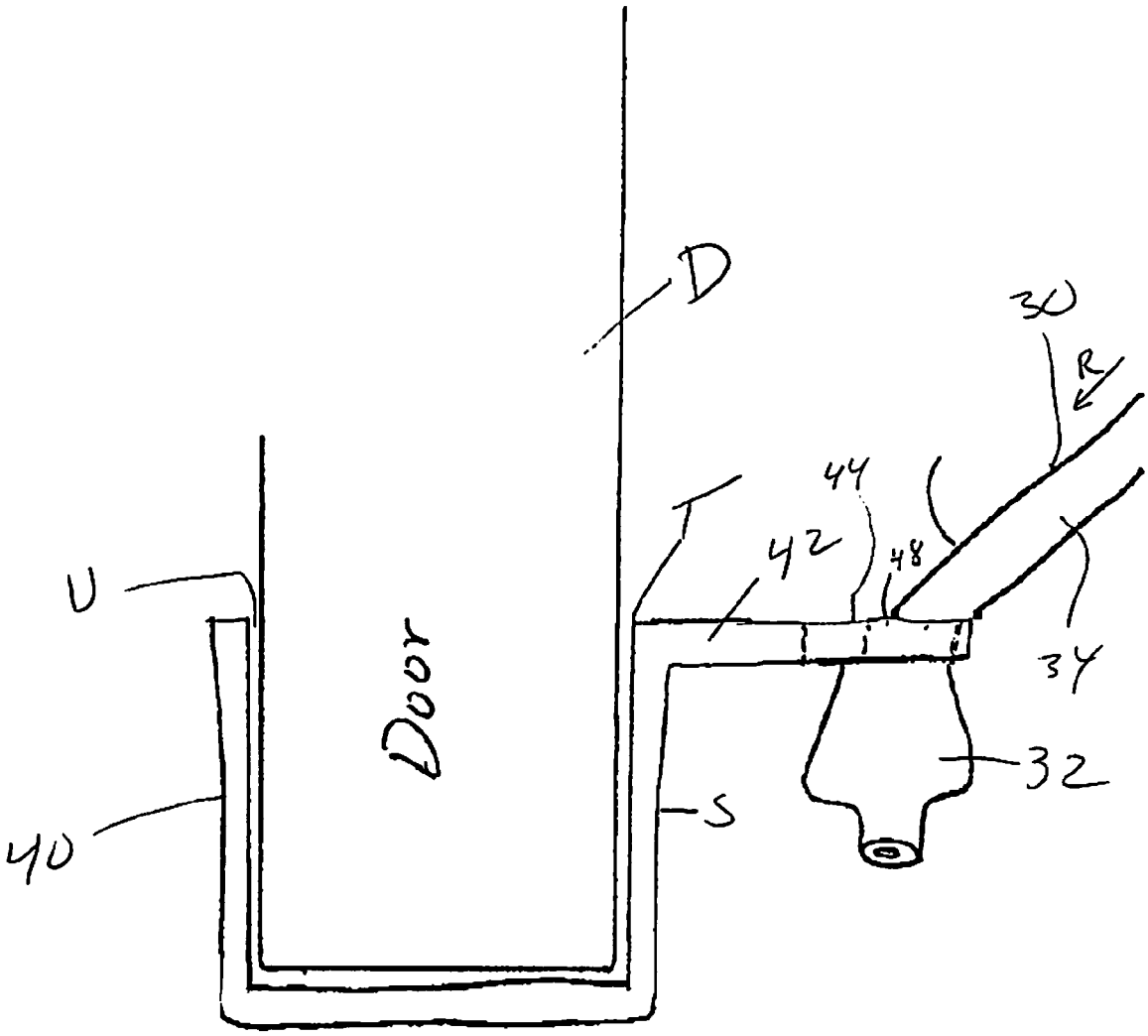
FIG. 4 is a side view of one embodiment of a door clip and tensioning element of the present invention.
Figure 5:
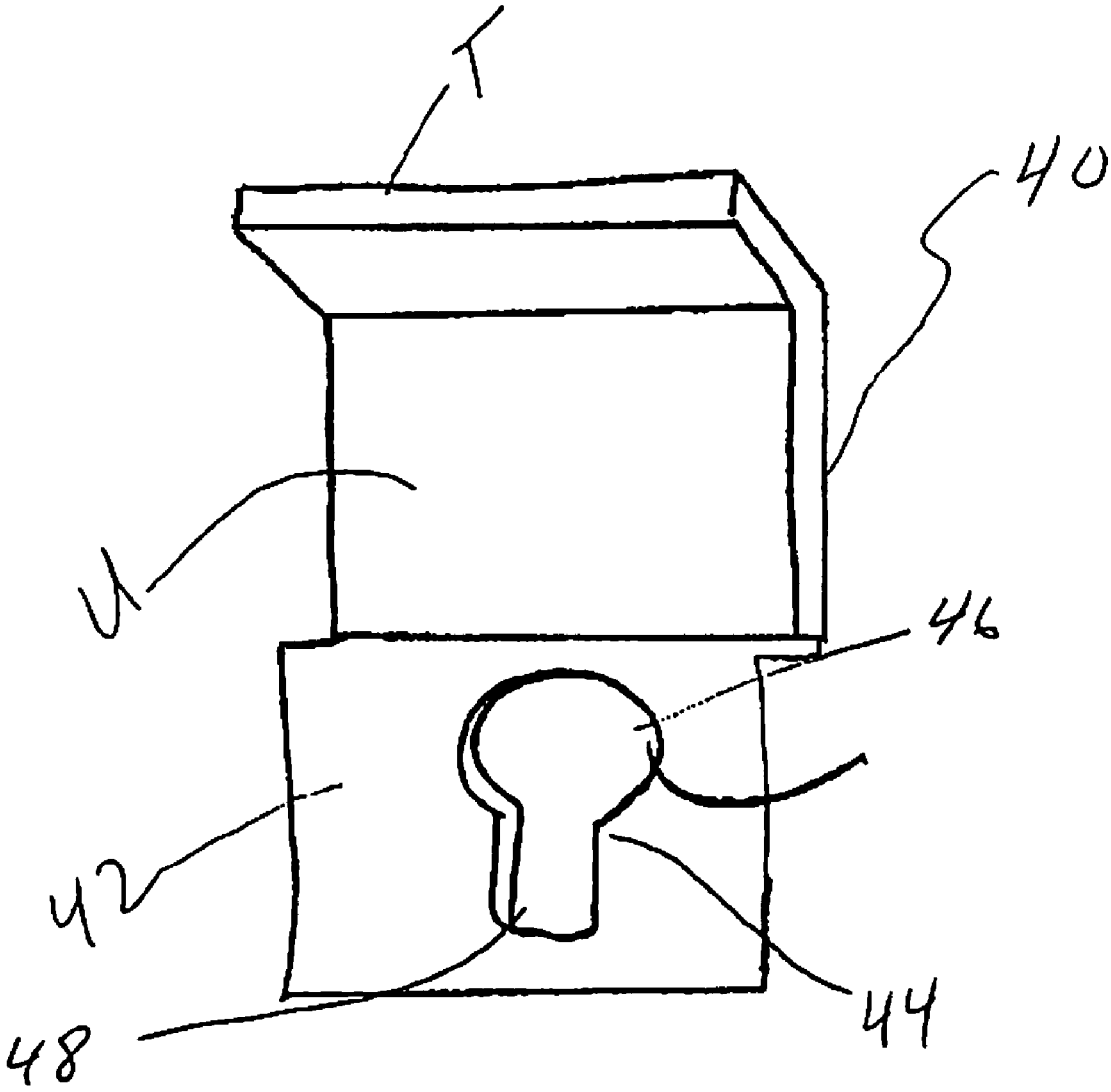
FIG. 5 is a top perspective view of one embodiment of a door clip of the present invention.

One embodiment of the door clip 40 is illustrated in FIGS. 4 and 5. FIG. 4 provides a side view of the door clip 40 engaged on the bottom of door D. A u-channel U is provided to allow the door clip 40 to slidingly engage door D, with door D engaged within u-channel U. A lip 42 is provided on one side of door clip 40, at the top T of the u-channel U and roughly perpendicular with the adjacent side S of u-channel U. As best illustrated by viewing FIGS. 4 and 5 in combination, a tension element aperture 44 is provided through lip 42. The tension element aperture 44 comprises an enlarged access portion 46 having a surface area and a retention portion 48 having a surface area smaller than the surface are of enlarged access portion 46, the access portion 46 and the retention portion 48 further allowing sliding communication therebetween.

As best illustrated in FIG. 4, tension element 30 may comprise opposing enlarged ends 32 that are enlarged relative to the middle shaft 34 and is preferably symmetrical in profile, thus comprising enlarged ends 32 on each end of tension element 30 with middle shaft 34 therebetween. Tension element 30 is composed of a material that resistively stretches when subjected to a longitudinal force such as that applied in the present invention. Such a tension element 30 is well known in the art. Middle shaft 34 will comprise a diameter that is smaller than the diameter of opposing enlarged ends 32. Thus, the enlarged ends 32 may fit within both the access portion 46 of tension element aperture 44 on lip 42 of door clip 40 as well as within access aperture 28 of handle 20. Sliding the middle shaft 34 portion of tension element 30 into the smaller retention portion 48 results in the enlarged end 32 engagingly retained within retention portion 48, thus removably fixing enlarged end 32 of tension element 30 to door clip 40 which is, in turn, removably attached to door D.

Similarly, the opposite enlarged end 32 of tension element 30 may be engaged with the handle 20 by passing enlarged end 32 into and through access aperture 28. The middle shaft 34 portion of tension element 30 may then slide through slot 27 until the desired retention aperture 29 is encountered. Each retention aperture 29 is located a different distance from the input load point where the user's hands grip the handle 20. Thus, each retention aperture 29 comprises a different resistance arm length resulting in a different resistance for the user. The enlarged end 32 of tension element 30 is larger than retention aperture 29 so as to engagingly retain the enlarged end 32 within retention aperture 29, thereby removably fixing the enlarged end 32 of tension element 30 within retention aperture 29 and to handle 20. As suggested by FIG. 3, one or more retention apertures 29 may be provided, each one providing more or less resistance during the swing training exercise as will be discussed further infra. At this point in the installation process, the tension element 30 is now adjustably fixed to both the door clip 40 and to the handle 20 and, as the Figures suggest, and as illustrated by the force directional arrows, tension element 30 provides a resistance force R away from the handle 20 and toward door clip 40 and door D along the taut tension element 30 at angle $\alpha$ as it is stretched by the user during operation and use. Angle $\alpha$ generally comprises the angle below the taut, stretched tension element 30 and the door D, or the extended line of the door D as in FIG. 1.

The embodiment illustrated in FIG. 1, comprises the door clip 40 attached to the bottom of door D. This allows the user to engage follow-through muscles in a swing that may be used in a sports swing, e.g., golf, tennis or baseball swing. The at least one tension element 30 provides resistance as the user moves through early swing movement and follows through. In this embodiment, the at least one tension element 30 does not provide resistance to either the user's initial back swing in a golf swing or the early swing curvature following the back swing. The at least one tension element 30 engages and resists at an angle $\alpha$ roughly equivalent to that encountered in the swing's engagement with, e.g., a golf ball, and continues to provide resistance through the full follow through of the swing.

Returning now to FIGS. 1 and 2, the present invention is illustrated in the context of a right-handed swing. The right-handed swing posture is defined herein as the posture wherein the user's right hand RH is below the left hand LH on the handle 20, i.e., the left hand LH being closer than the right hand RH to the proximal end 22 and the right hand RH being closer than the left hand LH to the distal end 24. In addition, the user's right shoulder RS is oriented closer to the door than the user's left shoulder LS, wherein the user's shoulders RS and LS are roughly perpendicular to the door D prior to initiation of a training swing.

The inventive swing trainer in all embodiments applies equally to a left-handed swing, defined herein as the posture wherein the user's left hand LH is below the right hand RH on the handle 20, i.e., the right hand RH being closer than the left hand LH to the proximal end 22 and the left hand LH being closer than the right hand RH to the distal end 24. In addition, the user's left shoulder LS is closer to the door D than the user's right shoulder RS, wherein the user's shoulders RS and LS are roughly perpendicular to the door D prior to initiation of a training swing. All embodiments described herein, and equivalents thereof, of the present invention are equally applicable to a right-handed or left-handed swing. Thus, the right-handed swing will be used to illustrate and describe the present invention. The skilled artisan will recognize immediately the application of the described embodiments to a left-handed swing.

Further, FIG. 1 illustrates the door clip 40 being installed and located below the user's hands. This configuration and orientation allows, as described supra, to work on follow-through muscles during, e.g., a golf swing by developing/training these muscles and/or stretching and/or warming them prior to developing/training and/or actually playing the game itself. The user with a right-handed swing may, however reorient him or herself relative to the swing trainer 10 in an orientation opposite that of FIG. 1 by simply turning to facing in the opposite direction so that the user's left shoulder LS is closer to the door D than the user's right shoulder RS. In this configuration, the user may work on the right-handed swing muscles involved in the early backswing of, e.g., a golf swing, with the resistance coming from an angle $\alpha$ and below the user's hands.

Significantly, the door clip 40 may be moved to any point around the perimeter of the door D, thus enabling the user to work on virtually all parts of any sports swing. For example, FIG. 2 illustrates the door clip 40 engaged with the top of door D and above the user's hands during a right-handed swing, in particular the early swing portion of a right-handed swing. This configuration allows the user with a right-handed swing to work on early swing muscles when swinging downwardly as in, e.g., a golf swing. The at least one tension element 30 does not necessarily engage on the user's backswing, in the case of a golf swing, but does engage as the user's hands descend through the downswing, again as in the case of a golf swing.

As should now be clear to the skilled artisan, the user may reorient him or herself in the illustrated configuration of FIG. 2 so that the user with a right-handed swing is oriented with his or her left shoulder LS closer to the door than the right shoulder RS and both shoulders LS, RS roughly perpendicular to door D before initiating the portion of the swing to be trained. In this configuration, i.e., door clip 40 above the user's hands and left shoulder LS closer to door than right shoulder RS, the user may work on another aspect of the swing, e.g., the initial backswing in a golf swing with the resistance coming from an angle $\alpha$ above the user's hands instead of from below the user's hands as in FIG. 1.

The swing trainer 10 may be configured so that door clip 40 is located along the side perimeter of door D at any point between the bottom location of door clip 40 shown in FIG. 1 and the top location of door clip 40 shown in FIG. 2. This configurability and flexibility of the swing trainer 10 allows the user to train swing muscles from virtually any angle during any portion of the swing and for virtually any type of sports swing. For example, one configuration of swing trainer 10 that may be used for baseball and/or tennis swings may comprise placement of the door clip 40 at progressive locations beginning with a location just above the user's knees, or lower, to just above the user's chest, or higher. One such exemplary location is illustrated in FIG. 2 as element 40A, with angle $\alpha_A$. As described above, the user may work on a forward swing, as in a baseball swing as well as on a backswing, as in a tennis swing, from virtually any angle $\alpha$.

Moreover, as should be apparent at this point, the present invention may also be used to target and stretch and/or warm the swing muscles using the techniques described above and employing virtually any angle $\alpha$.

Figure 6:
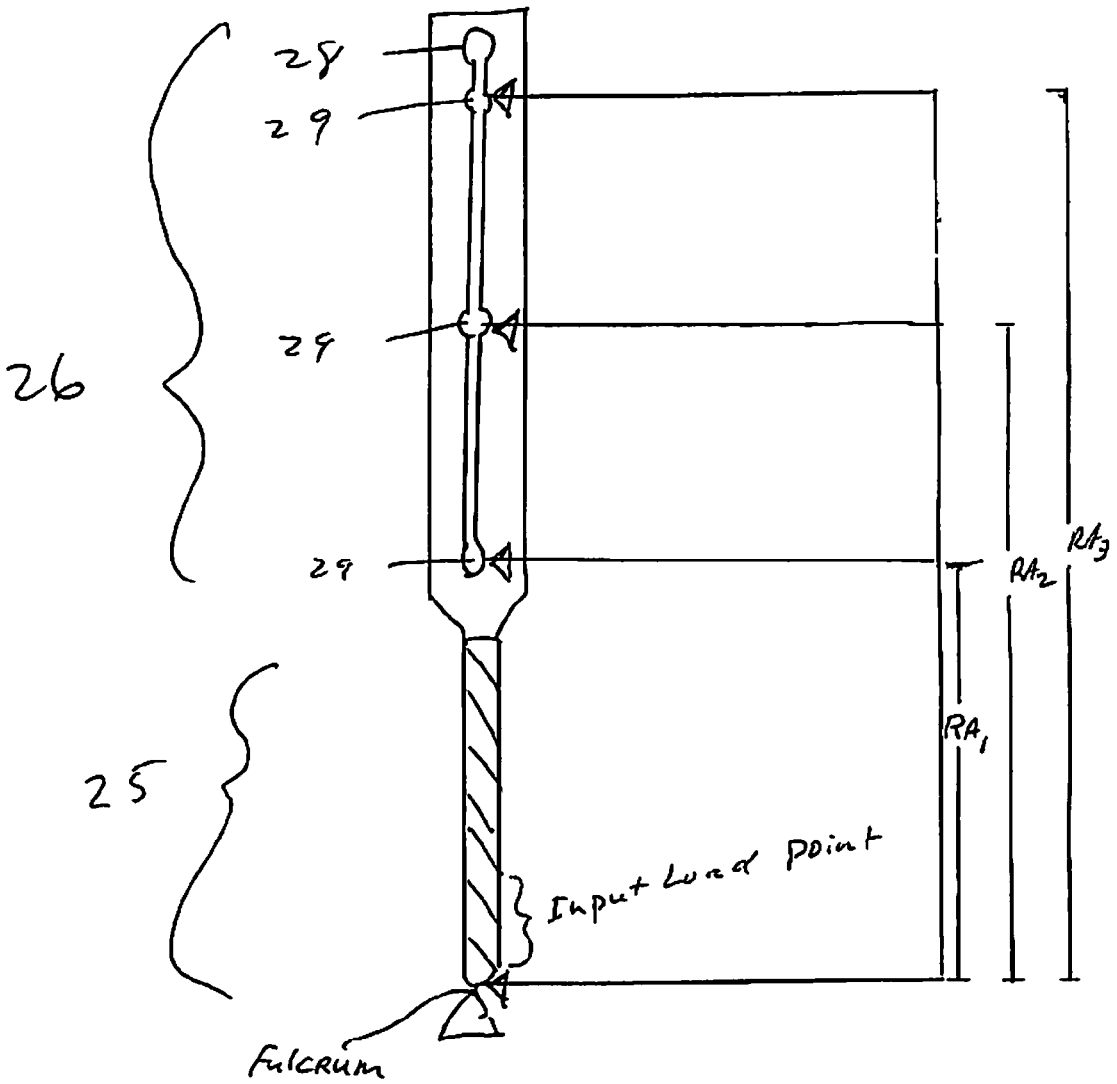
FIG. 6 is a front view of one embodiment of a handle of the present invention.

Further, the resistance of the swing trainer 10 may be modified. FIG. 6 illustrates some of the potential configurations of the present invention and the resulting variation of resistance arm length.

Generally speaking, the swinging of a sports club, e.g., a golf club, tennis racket or a baseball bat, employs a class 3 lever to gain mechanical advantage. FIG. 6 depicts the elements of such a lever, i.e., the fulcrum or rotational axis of the lever, the input load point, i.e, the position of the user's hands on the grip portion 25 and the output load resistance point located along the resistance portion 26.

In the present invention, the fulcrum may typically be at the end of the grip portion 25, although the user may move his/her hands up or down on the grip to cause the fulcrum or rotational axis of the lever to move up or down on the grip portion 25. The fulcrum is so indicated in FIG. 6 as at the tip of the triangle illustrated at the end of grip portion 25. Further, the input load point is the point at which the user's hands apply pressure, most typically near the end of grip portion 25, thus resulting in the fulcrum or rotational axis of the lever being located at the very end of grip portion 25.

Further, the present invention comprises the ability to position the at least one tension element 30 at varying positions along the resistance portion 26, by connecting the tension element(s) 30 with one of the at least one retention apertures 29. Thus, the load, i.e., the resistance R provided by the at least one tension element 30, may be adjustably positioned along resistance portion 26.

Thus, in mechanical advantage terms, assuming the input load point, i.e., the user's hand position and the amount of resistance R provided by the at least one tension element 30 remain constant, the force applied by the user at the input load point varies in a directly proportional manner with the increasing length of the resistance arm. Thus, as illustrated, $RA_1$ is the shortest resistance arm and requires the least force to be applied by the user. In other words, the handle 20 is easiest to move against the at least one tension element 30 at resistance arm length $RA_1$. $RA_2$ and $RA_3$ provide successively longer resistance arms and proportionally greater force is required to be applied by the user at the input load point, i.e., the swing through is made successively more difficult at resistance arm lengths $RA_2$ and $RA_3$. It is contemplated that, as the user gains in strength, that the resistance arm lengths may be increased to further strength gains.

Changing the resistance arm length is just one possible way to adjust the resistance encountered by the user during a swing using the swing trainer 10. Other methods may comprise keeping the resistance arm a constant length, but substituting in successively more, or less, resistant tension element(s) 30. It is contemplated that the at least one tension element 30 may comprise two, three or more tension elements 30, each having an increasing resistance. The skilled artisan will readily recognize the various configurations that may now be used to modify the resistance force encountered by the user; each such configuration is within the scope of the present invention.

Figure 7A:
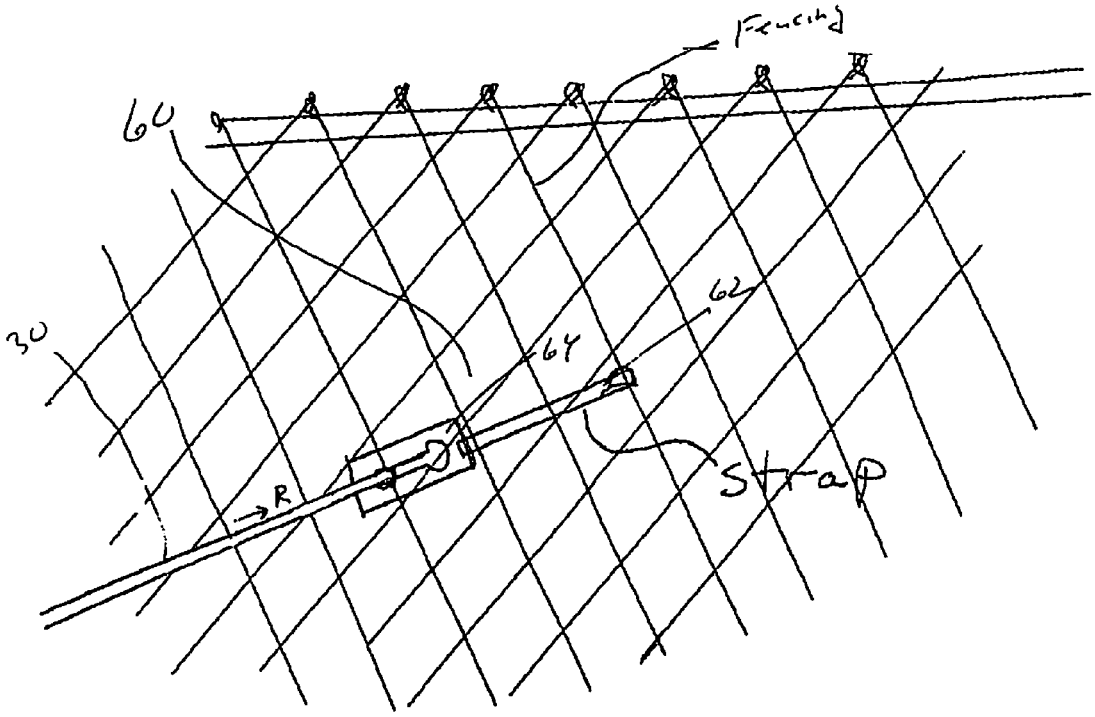
FIG. 7A is a front view of one embodiment of the present invention.
Figure 7B:
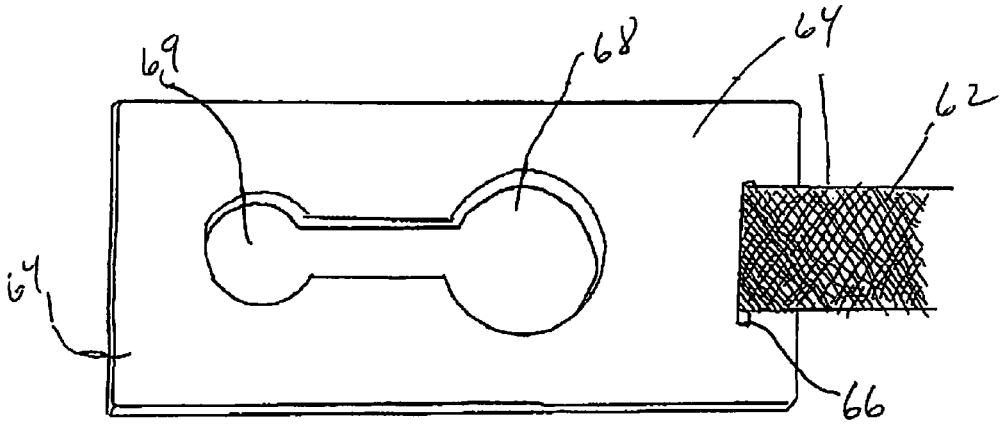
FIG. 7B is a front view of one embodiment of the present invention.

Finally, turning now to FIGS. 7A and 7B, an alternate mounting mechanism for the swing trainer 10 is provided. The door clip 40 described above is replaced in this embodiment with a strap mounting element 60 that may be fixed to virtually any fixed structure that the mounting element 60 may engage. Strap mounting element comprises a flexible strap 62 in adjustable fixed communication with connecting element 64. Connecting element 64 comprises a flexible strap aperture 66, a tension element access aperture 68 and a retention aperture 69. The apertures 68, 69 are provided, as illustrated, to retain one end of enlarged end 32 of tension element 30 as described above. Strap 62 adjustably and fixedly attaches to a fixed structure, e.g., fencing, via a looping in the strap 62 and the flexible strap aperture 62, the swing trainer 10 is further attached to the fencing or other fixed structure at the desired angle and the swing trainer is then ready for operation as provided supra. This alternative mounting mechanism increases the portability and utility of the swing trainer 10 by allowing by attachment and use virtually anywhere there is a fixed structure. For example, and without limitation, fencing, a bumper, trailer hitch, light post and the like may be used to connect the swing trainer 10 and allow the user to stretch, warm up and/or train swing muscles.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A sports swing training device comprising:

a handle having a grip portion and a resistance portion, the resistance portion comprising an access aperture, at least one retention aperture and a slot, the access aperture, more than one retention aperture and slot extending through the handle and being in communication with each other;

a door clip comprising a u-channel and a lip, the lip comprising a tension element aperture, the tension element aperture comprising an enlarged access portion and a retention portion, wherein the u-channel engages a door; and interchangeable tension elements, each interchangeable tension element comprising a resistance, each interchangeable tension element having a resistance that differs from the other interchangeable tension elements, opposing enlarged ends and a middle shaft, wherein one opposing enlarged end removably engages the handle's retention aperture and the other opposing enlarged end removably engages the door clip's retention portion, wherein each of the more than one retention aperture defines a resistance arm, each resistance arm comprising a length, wherein the shortest resistance arm requires the least force to be applied by a user at the grip portion and successively longer resistance arms require proportionally more force to be applied by a user at the grip portion, and wherein the force required to be applied by a user is changed by changing to an interchangeable tension element of different resistance and/or changing the resistance arm length.

2. The sports swing training device of claim 1, further comprising an angle $\alpha$ between the tension element and the door.

3. The sports swing training device of claim 2, further comprising the angle α between the tension element and the door being adjustable.

4. A sports swing training device comprising:

a handle having a grip portion and a resistance portion, the resistance portion comprising a handle having a grip portion and further having an access aperture, more than one retention aperture and a slot, the access aperture, more than one retention aperture and slot extending through the handle and being in communication with each other, wherein each of the more than one retention aperture comprises successively longer resistance arms;

a door clip comprising a u-channel and a lip, the lip comprising a tension element aperture, the tension element aperture comprising an enlarged access portion and a retention portion, wherein the u-channel engages a door;

interchangeable tension elements comprising opposing enlarged ends, a middle shaft and a resistance, wherein one opposing enlarged end engages the handle's retention aperture and the other opposing enlarged end engages the door clip's retention portion wherein each of the more than one retention apertures defines a resistance arm, each resistance arm comprising a length, wherein the shortest resistance arm requires the least force to be applied by a user at the grip portion and the longest resistance arm requires the most force to be applied by a user at the grip portion, and wherein the force required to be applied by a user is changed by changing to an interchangeable tension element of different resistance and/or changing the resistance arm length; and an angle α between the tension element and the door, wherein the angle α between the tension element and the door is adjustable.

5. A sports swing training device comprising:

a handle having an access aperture, more than one retention aperture and a slot, the access aperture, more than one retention aperture and slot extending through the handle and being in communication with each other;

a strap mounting element comprising a flexible strap in adjustable fixed communication with a connecting element, wherein the connecting element comprises a flexible strap aperture, a tension element access aperture and a retention aperture, wherein the strap mounting element engages a fixed structure; and interchangeable tension elements comprising opposing enlarged ends and a middle shaft and a resistance, each interchangeable tension element comprising a different resistance than the other interchangeable tension elements, wherein one opposing enlarged end engages the handle's retention aperture and the other opposing enlarged end engages the connecting element's retention aperture wherein each of the more than one retention apertures defines a resistance arm, each resistance arm comprising a length, wherein the shortest resistance arm requires the least force to be applied by a user at the grip portion and the longest resistance arm requires the most force to be applied by a user at the grip portion, and wherein the force required to be applied by a user is changed by changing to an interchangeable tension element comprising a different resistance and/or chancing the resistance arm length.

* * * * *